US005345252A

United States Patent [19]

Hannah

[11] Patent Number: 5,345,252

[45] Date of Patent: Sep. 6, 1994

[54] HIGH SPEED CURSOR GENERATION APPARATUS

[75] Inventor: Marc Hannah, Mountain View, Calif.

[73] Assignee: Silicon Graphics, Inc., Mountain View, Calif.

[21] Appl. No.: 732,793

[22] Filed: Jul. 19, 1991

[51] Int. Cl.[5] ..... G09G 5/08

[52] U.S. Cl. ..... 345/162; 345/159; 345/197

[58] Field of Search ..... 340/723, 799, 724, 709; 345/159, 162, 185

[56] References Cited

U.S. PATENT DOCUMENTS

| | | | |
|---|---|---|---|
| 4,190,835 | 2/1980 | Buynak | 340/724 |
| 4,245,244 | 1/1981 | Lijewski et al. | 340/709 |
| 4,454,507 | 6/1984 | Srinivasan et al. | 340/747 |
| 4,668,947 | 5/1987 | Clarke, Jr. | 340/709 |
| 4,706,074 | 11/1987 | Muhich et al. | 340/799 |
| 4,851,834 | 7/1989 | Stockebrand et al. | 340/799 |
| 4,987,551 | 1/1991 | Garrett, Jr. | 340/734 |
| 5,001,469 | 3/1991 | Pappas et al. | 340/799 |

FOREIGN PATENT DOCUMENTS

| | | | |
|---|---|---|---|
| 418859A1 | 3/1991 | European Pat. Off. | 340/709 |
| 3-288194 | 12/1991 | Japan | 340/709 |

*Primary Examiner*—Ulysses Weldon
*Assistant Examiner*—Amare Mengistu
*Attorney, Agent, or Firm*—Blakely, Sokoloff, Taylor & Zafman

[57] ABSTRACT

A cursor generator for use in a computer system having a high pixel clock rate. The cursor generator includes a first memory which stores a line of the cursor for display on the display device and a second memory which stores the entire cursor. The data for the line of the cursor can be more quickly retrieved from the first memory than from the second memory, and the first memory is clocked under the control of the high pixel clock rate while the second memory is clocked at a slower clock rate. A controller couples data for the one line of the cursor from the second memory, which is typically dynamic random access memory to the first memory which is typically a high speed register or a combination of registers and multiplexors. The controller couples the data for one line at a time of the cursor to the display device in order to display the cursor in conjunction with the rest of time image displayed on the display device.

16 Claims, 12 Drawing Sheets

HIGH SPEED CURSOR GENERATION APPARATUS

FIELD OF THE INVENTION

The present invention relates generally to computer display systems having a cursor and more particularly to an apparatus for generating cursors for display on display devices controlled by a computer.

BACKGROUND OF THE INVENTION

Computer systems often include a display device, such as a cathode ray tube (CRT) or a liquid crystal display which provides a display of information generated by the computer and which also displays a cursor with the other information on the display device. Often, this display device is a raster scanned device such as a video CRT, and the cursor is generated on the screen on the display device in a line by line manner as with the other information which is displayed on the device. It will be appreciated that the cursor is used by the user to indicate some operation to the computer and also tells the user the position at which a data input may occur. FIG. 5 shows a typical cursor of the prior art which is labeled as cursor 203. As is well know, a user may control the movement of the cursor 203 by an input device, such as a mouse, to cause the pointer to appear over an object which is also displayed on the screen in order to select that object or to insert text at the location indicated by the cursor, etc.

FIG. 1 shows a typical prior art implementation of an apparatus which generates the cursor for display on a computer controlled display device. It will be appreciated that the frame buffer 10 contains the information in digital form which is to be displayed in a bit-mapped manner onto the display device. Bus 16 provides the digitized display data through the multiplexor 12 and the bus 22 to a digital to analog (D/A) converter. The D/A converter is coupled to the display device to provide the analog values of the bit mapped image to the display device in the well known manner of the prior art. Typically, most of the screen area of the display device will be occupied by information obtained from the frame buffer 10, and very little of that screen space will be taken up by the cursor which is positioned at some point on the screen of the display device.

The digitized image of the cursor is stored in the memory 11 which is often a static random access memory (SRAM) which is addressed by the address counter 15 via the address and control bus 18 so that the cursor memory 11 provides an output of the value of the cursor's digitized image at the particular addressed location over line 21 to the multiplexor 12. The NOR gate 19 is coupled to receive the output values from the cursor memory 11 and it determines, via its output which is coupled to the select line 20 of the multiplexor 12, whether the value of the cursor or the value of the frame buffer at the particular pixel location of the display device will be sent through the multiplexor 12 to the D/A converter and ultimately to the display device. Thus, the NOR gate 19 and the select line 20 will select between information in the frame buffer 10 or information in the cursor memory 11 depending on whether a zero or a one is present on line 21. It will be appreciated that whenever the value of the cursor is zero (e.g. no color) then the values from the frame buffer at that particular pixel will be selected by the multiplexor 12 for display on the display device.

The controller 14 provides for the control of the cursor memory 11 through the address counter 15. The controller 14 generates the appropriate signals to cause the address counter to count sequentially through locations in the cursor memory 11 to provide a sequential output of the cursor data from the cursor memory 11. Each line of the cursor data represents a portion of the raster scanned line which is currently being read out from the frame buffer 10. The cursor memory will often provide a limited amount of storage; for example, a typical cursor size is 32 pixels by 32 pixels. The controller 14 receives an input indicating the starting X (Xs) and the starting Y (Ys) position of the cursor, which position typically indicates the upper left land corner of the block area (usually rectangular) of the cursor, such as the upper left hand corner of the cursor block 202 shown in FIG. 5. It will be appreciated that there are many ways well known in the prior art which can provide this starting position, such as techniques for determining the position of a cursor control device such as a mouse. The controller 14 typically also includes an input for the vertical length (YI) of the cursor block such as the vertical length in FIG. 5 shown between dashed lines 206 and 207. The controller 14 also includes inputs for receiving the pixel clock which is the clock which controls the rate at which pixels are displayed and refreshed on the display device in the normal raster scanned manner. Furthermore, the controller 14 includes an input to receive the horizontal and the vertical retrace signals which are provided in the normal fashion by the video control circuitry in order to create a typical raster scanned image on a display device.

Prior art cursor generating apparatuses, while providing an effective means for displaying cursors in typical computer systems, do not provide a high enough throughput in faster computer systems where the pixel clock is operated at very high frequencies. In these circumstances, depending on the rate of the pixel clock, it is often possible to improve the speed of these cursor generators by using faster memory integrated circuits for the cursor memory 11, such as very fast static RAM. However, these memories are often still not fast enough to achieve a proper sequential output from the memory at very pixel clock rates.

Consequently, it is an object of the present invention to provide an improved apparatus for generating a cursor at a high speed for a high speed computer display system, particularly where the pixel clock is operating at a very high rate. These high pixel rates are often mandated by the size of larger screens on display devices which require that, in order to prevent the flickering of the displayed image to which the eye is so sensitive, the pixel clock be accelerated in order to draw the entire image in the typical raster scan manner on the screen at least 30 frames per second. It is a further object of the present invention to provide a sophisticated embodiment for a cursor generator in those circumstances where typical CMOS integrated circuits are too slow to keep up with very high pixel clock rates.

SUMMARY OF THE INVENTION

An improved cursor generator is provided for use with computer controlled display devices having high pixel clocks which require a continuous stream of data for the cursor image at a high rate. The cursor generator includes a first memory means which stores a line of the cursor for display on the display device and a second memory means which stores the entire cursor. The data for the line of the cursor can be more quickly retrieved from the first memory means than from the second memory means. A control means couples data for the one line of the cursor from the second memory means, which is typically dynamic random access memory, to the first memory means which is typically a high speed register or a combination of registers and multiplexors. A control means further couples the data for one line at a time of the cursor to the display device in order to display the cursor in conjunction with the rest of the image displayed on the display device.

In a typical embodiment, after the beginning of a horizontal retrace during the standard refreshing of the display device, one line of the cursor will be loaded into the first memory means from the second memory means. Typically, the horizontal retrace time is sufficiently long to allow the entirety of a single line of the cursor to be addressed and loaded into the first memory means from the second memory means. In a typical embodiment, the first memory means will be some form of a register which is parallel loaded with data from the second memory means. That data is then shifted out from the second memory sequentially to provide a continuous stream, at the pixel clock rate, of cursor data for display on the display device. After the occurrence of the next conventional horizontal retrace of the display device, the next line for the cursor is loaded from the slower first memory means into the first memory means for the next raster scan line refresh operation.

In a preferred embodiment of the present invention, the apparatus for generating a cursor uses a combination of an input register and two sets of multiplexors and an output register to provide higher throughput which is required in cases where the pixel clock rate is very high. In this embodiment, a first memory means stores the entire cursor, which memory means is typically a conventional, relatively slow DRAM which contains enough storage space to hold the digitized image of the cursor (e.g. 32 pixels by 32 pixels). An input register is selectively coupled to this first memory means by a control means which addresses the first memory means during a horizontal retrace to obtain one of the lines of the cursor data stored in the first memory means. The control means then loads this line into the input register. The input register is coupled to a first multiplexing means which in turn is coupled to a second multiplexing means. A means for controlling the first multiplexing means and the second multiplexing means are provided in order to route signals from the input register to an output register. The output register is coupled to the second multiplexing means to receive bit values for one of the lines of the cursor image. Typically, only a portion of a line for the cursor is provided at a single time to the output register. This output register is in turn coupled to a multiplexor which serializes the parallel output of the output register in order to provide a stream of cursor values to the display device.

DETAILED DESCRIPTION OF THE PRESENT INVENTION

The following description will refer to specific architectures, circuits, specific control signals and cursor sizes in order to provide a complete understanding of the present invention. It will be appreciated that these specific details are provided for purposes of illustration and are not to be construed to limit the scope of the invention; moreover, it will be appreciated that many variations and modifications can be made by those in the art based upon the description provided here.

Figure 1:
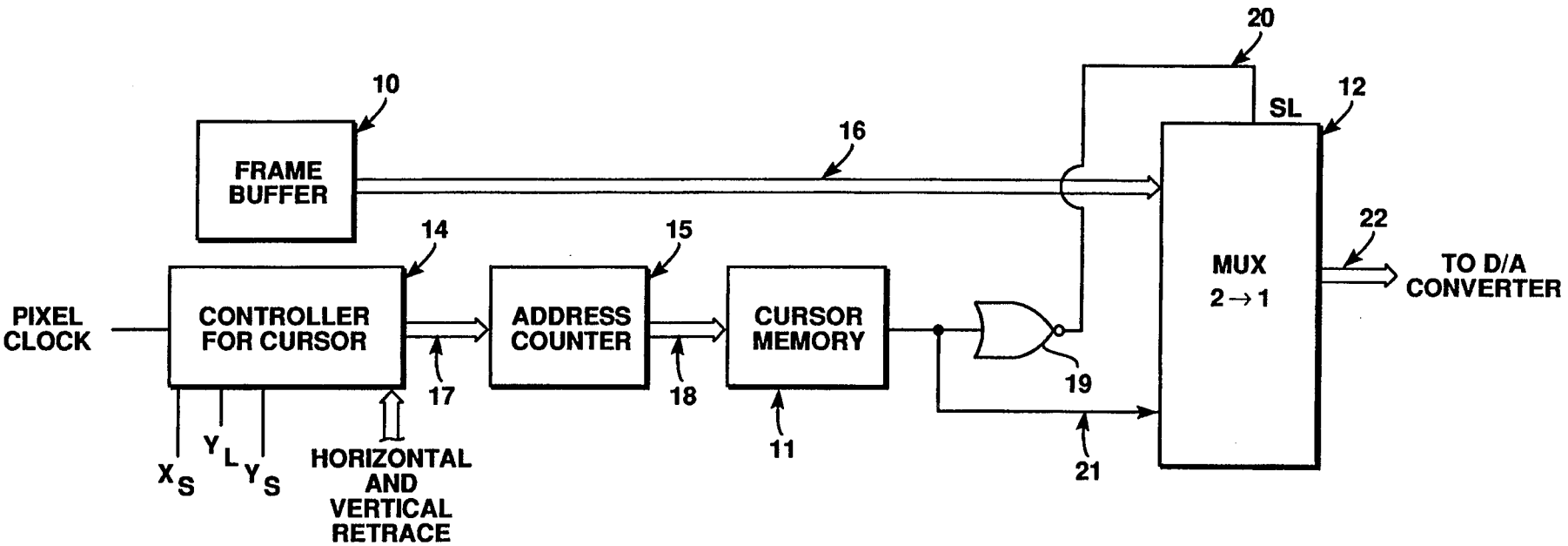
FIGURE 1 (PRIOR ART)
FIG. 1 shows a typical prior art apparatus for generating a cursor in a computer system.
Figure 2:
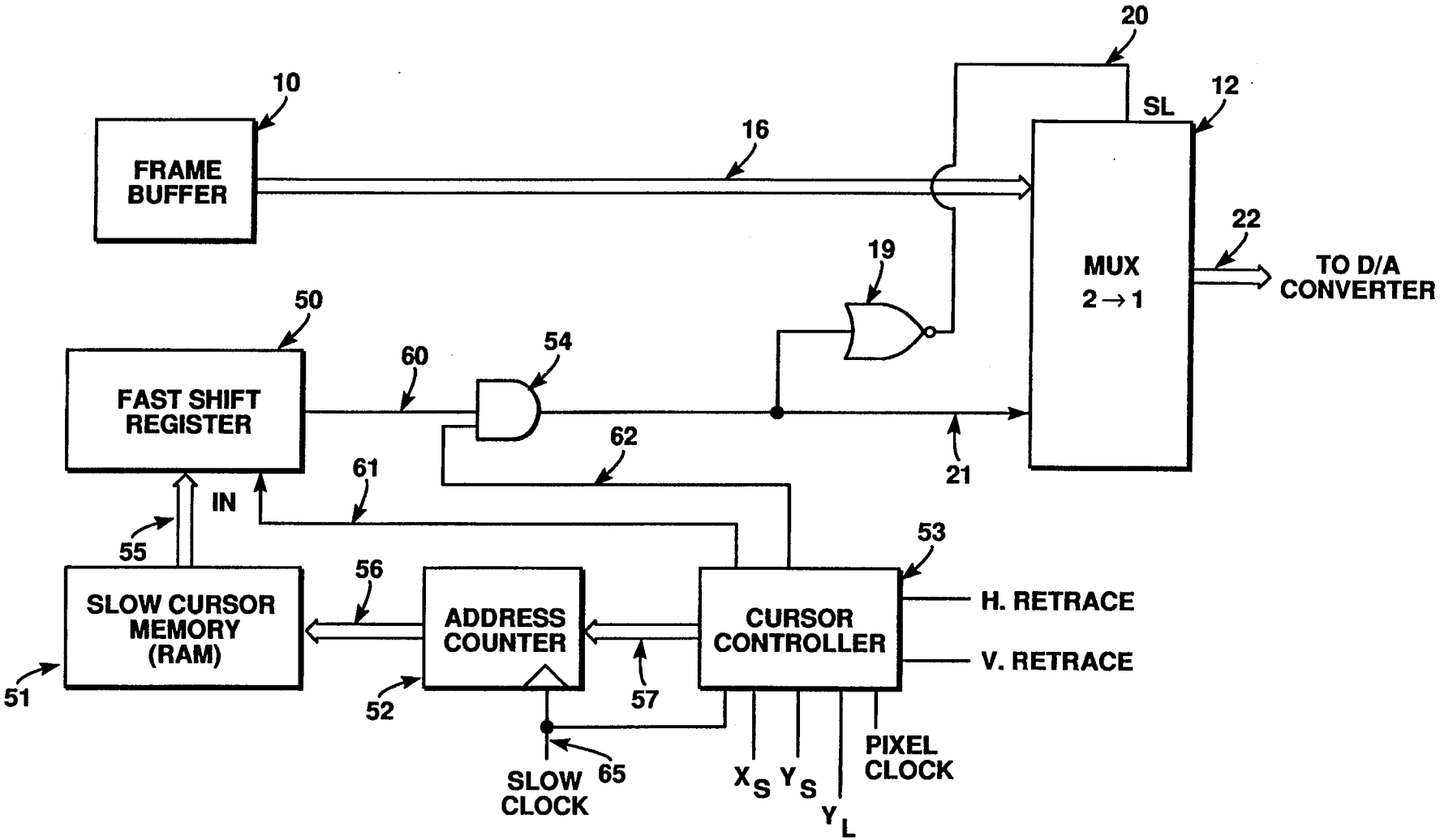
FIG. 2 shows an embodiment of the present invention for generating a cursor.

FIG. 2 shows a cursor generator according to the present invention; this cursor generator includes the cursor memory 51 and the shift register 50 as well as the address counter 52 and the cursor controller 53 and the AND gate 54. The output of the cursor generator is provided on line 21 which provides an input to the multiplexor 12 and to the NOR gate 19. It will be appreciated that the output of the NOR gate 19, as in the prior art implementation shown in FIG. 1, selects between the display information stored in frame buffer 10 and the display information for the cursor stored in the cursor memory. The selected input is determined by the status of the signal on the select line 20 of the multiplexor 12 and that selected input is provided over bus 22 to the display device.

The cursor memory 51 shown in FIG. 2 provides storage for the information representing the image of the cursor; this information is typically 32 pixels wide by 32 pixels long and hence the cursor memory 51 is typically the equivalent of 32 bits by 32 bits. In the case of a color cursor or any other cursor requiring more than two values to specify the image of the cursor, the cursor memory 51 will typically contain several bit mapped planes representing a cursor image. In this circumstance, the cursor memory is often the equivalent of 32 bits by 32 bits by 2 bits, where the 2 bits represent the 2 separate bit planes and provides the capability for the cursor to have three colors and an off state. Those skilled in the art will appreciate how to implement such a multiple value cursor by having two shift registers 50 and 50*a* (not shown) which provide two serial outputs 60 and 60*a* (not shown) to two AND gates 54 and 54*a* (not shown) the outputs of which are provided to both the multiplexor 12 and the NOR gate 19. Further details concerning a multiple value cursor will be described below.

Figure 3:
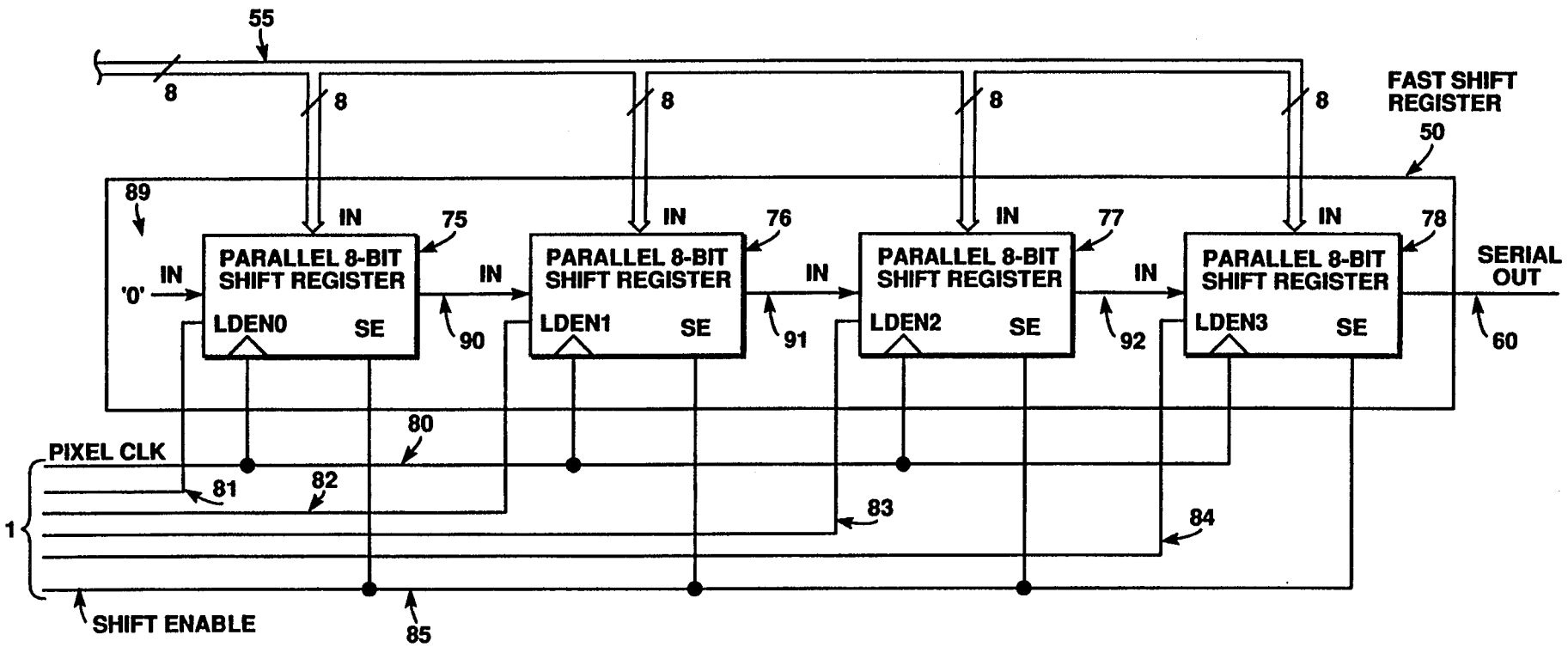
FIG. 3 shows, in block diagram form, the shift register 50 of FIG. 2.

The cursor memory 51 can be a slower cursor memory, such as a slower DRAM integrated circuit which is less expensive than the faster integrated circuits often required for the prior art cursor memory 11 in order to keep up with high pixel clock rates. Hence, the invention provides an economic advantage over the prior art as well as an advantage in the ability to operate with higher pixel clock rates which are often necessitated by larger display devices. The invention also provides an advantage where the cursor memory is shared memory which includes not only cursor data but also data for other purposes so that the cursor generator must share this memory with other functions which also require access to the shared memory; hence the cursor generator does not have access to the memory all the time and must minimize the time it takes to use this memory when it is available. Under the control of the cursor controller 53, the address counter 52 provides addresses and control signals over bus 56 in the conventional manner to the cursor memory 51 which then provides the cursor values over data bus 55 to the shift register 50, which is also under control of the cursor controller 53 via bus 61. Bus 61, as shown in FIG. 3, includes the pixel clock signal as well as four signals on lines 81,82, 83 and 84 which provide signals which control the loading of the shift registers within shift register 50. Also included within bus 61 is the signal shift enable on line 85 which enables the shifting in a serial manner of the data loaded into the shift register after all the data has been loaded and after the beginning of cursor block 202 as indicated by the horizontal x counter of FIG. 6*c* (when the Xs position has been reached). The serial data, when shifting is enabled, is provided from the shift register 50 to the AND gate 54 by the line 60, and this same data is enabled past the AND gate 54 by providing an X enable signal over line 62, which is also the same as the shift enable signal appearing on line 85. Thus, the output of the shift register 50 is provided through the AND gate 54 over line 21 into the multiplexor 12 when the X enable signal is present on line 62.

The cursor controller 53 is similar in some respects to the cursor controller 14 in the prior art cursor generator shown in FIG. 1. For example, the cursor controller 53 of FIG. 2 receives inputs indicating the existence of a horizontal retrace or the existence of a vertical retrace; these signals are the conventional horizontal retrace and vertical retrace signals found in computer systems for controlling the refresh of raster scan display devices, such as video monitors. The cursor controller 53 also includes an input for the pixel clock and an input indicating the starting the location of the cursor (Xs, Ys) and the vertical length of the cursor ($Y_L$). However, unlike the prior art cursor controller 14, cursor controller 53 includes an input for the slow clock 65 in order to operate the address counter at the slower clock rate, and it can also be seen that the cursor controller 53 provides the control bus 61 to the shift register 50 and the X enable signal over lines 62 to the AND gate 54. The slow clock signal is presented to the clock input of the address counter 52 since it is this clock which controls the address and control sequences for addressing the cursor memory 51, unlike the prior art cursor generator shown in FIG. 1. Further details concerning the cursor controller 53 will be provided below in conjunction with the discussion of FIGS. 5, 6*a*, 6*b*, 6*c*, and FIG. 7.

The detailed structure of the shift register 50 will now be described by referring to FIGS. 3 and 4. Shift register 50 is a "custom" shift register which is designed to hold the portion of the scan line covered by the cursor block 202 when the current scan line being refreshed on a display device is within the cursor block 202 shown in FIG. 5. The shift register 50 includes four 8 bit "shift registers" 75, 76, 77 and 78 which provide for the storage of 32 bits, which represents the horizontal width of the cursor block 202. These four shift registers are loaded from the same data bus 55 by sequentially enabling the loading of four 8 bit values provided over bus 55 at four different times while also providing four different load enable signals, such as load enable signal "LDEN0" over line 81. In other words, the cursor controller 53 will cause the address counter 52 to provide the address for the first byte over address bus 56 to the cursor memory 51 which then causes data for that first byte to be provided over bus 55 at the same time the load enable signal LDEN0 over line 81 will be active (while the load enable signals LDEN1, LDEN2, LDEN3 are all inactive) thereby allowing that first byte to be loaded into this shift register 75 in a parallel load manner. A similar operation occurs for shift register 76, as well as shift registers 77 and 78 in a sequential fashion. It can be seen that the pixel clock is provided over line 80 to the clock input of all four shift registers shown in FIG. 3, and this pixel clock will continue to run during a horizontal retrace in order to cause the loading of the four shift registers during the horizontal retrace. The four shift registers 75, 76, 77 and 78 are connected in series by the lines 90, 91 and 92 such that the serial output of register 75 is coupled to the serial input of register 76, and so on. The serial input 89 to register 75 is coupled to the logical value zero in order to shift out values of zero after the full 32 bits of the cursor have been shifted out of the shift register 50. The serial output of the shift register 50 will begin when the shift enable signal changes from an inactive state (when it maintains a zero logical value) to an active state which is represented by a logical value of one. Each shift register 75, 76, 77 and 78 is coupled to receive the shift enable signal.

Figure 4:
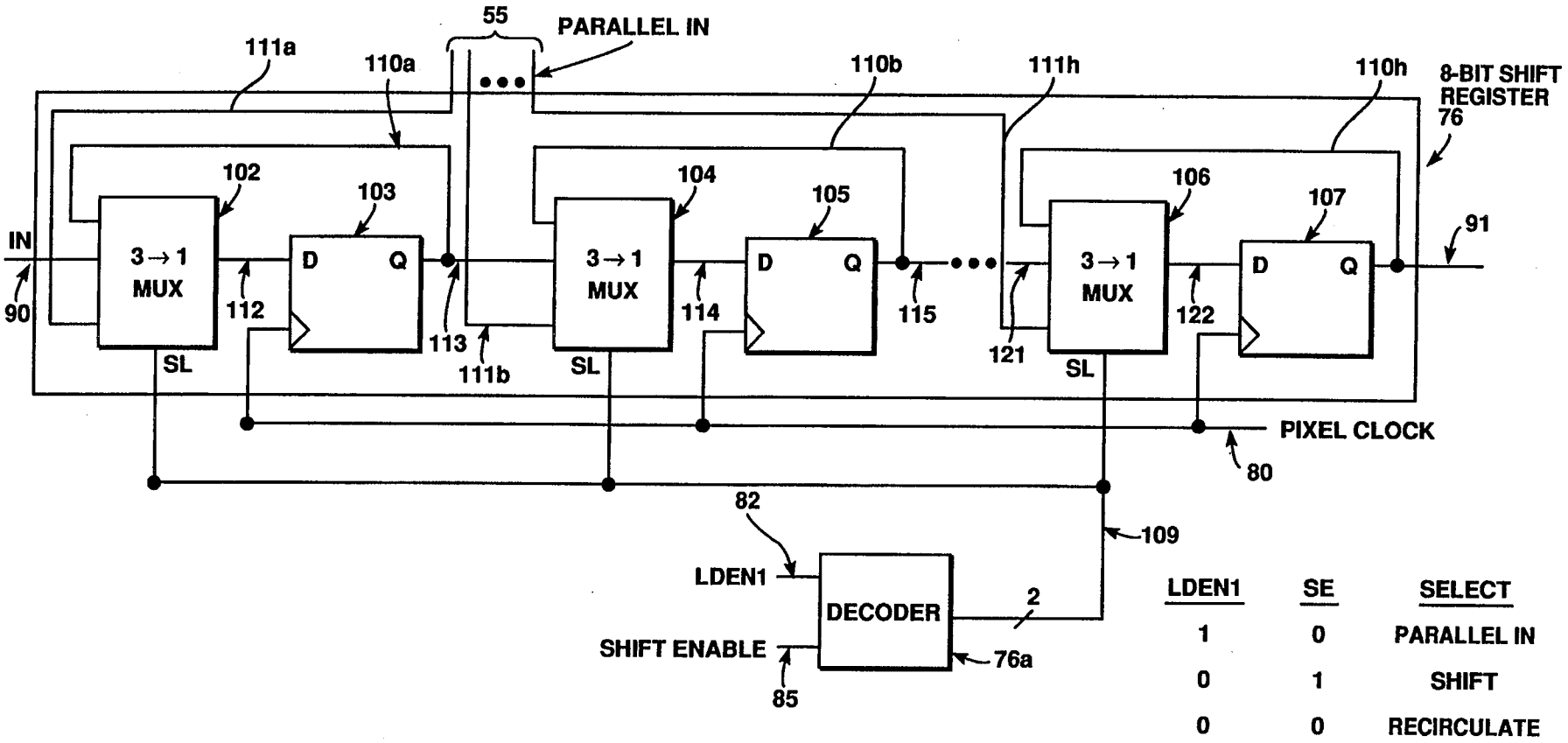
FIG. 4 shows one of the 8 bit shift registers of FIG. 3.

FIG. 4 shows an example of an implementation of one of the 8 bit shift registers within the shift register 50. In particular, FIG. 4 shows the shift register 76 which has the serial input coupled to line 90 and the serial output coupled to 91 and has the parallel input coupled to bus 55. The shift register 76 is comprised of eight pairs of a D flip flop and a 3 to 1 multiplexor; it will be appreciated that, in order to simplify the drawing, only three such pairs have been shown in FIG. 4. The shift register 76 is also shown with a decoder 76*a* which decodes the two signals LDEN1 and shift enable present on lines 82 and 85 respectively, which decoded signal is then applied over line 109 to the select line inputs of all eight 3 to 1 multiplexors; it will be appreciated that this decoder may not be necessary and the two signals 82 and 85 may be applied directly to the select line input in order to select between the three inputs to each 3 to 1 multiplexor. The output of each 3 to 1 multiplexor is coupled to the input of its respective D Flip flop. Thus, the output of multiplexor 102 is coupled to the D input of flip flop 103 by line 112, and the output of multiplexor 104 is coupled to the D input of flip flop 105 via line 114. The clock input to all flip flops is coupled to the pixel clock 80. The Q output of all but the last flip flop (flip flop 107) is coupled to the "middle" input of the next 3 to 1 multiplexor except for the first 3 to 1 . multiplexor (102) which has its middle input coupled to the serial input via line 90. The last of the eight D flip flops (flip flop 107) has its Q output coupled to the serial output (line 91). It can be seen that the "upper" input of each 3 to 1 multiplexor is coupled to receive the recirculated output of the respective flip flop. For example, the output of flip flop 102 is recirculated back to the multiplexor 103 via line 110*a*. Similarly, the output of the last flip flop 107 is recirculated back to the multiplexor 106 via line 110*h*.

The "bottom" input to each 3 to 1 multiplexor within register 76 is coupled to one of the eight lines within the bus 55 to receive parallel input data. Thus it can be seen that the top input to each multiplexor is a recirculation input, and that the middle input to each multiplexor is a "shift" input which, when selected, allow the serial shifting of data through the register 76 in the normal manner of a standard shift register. When the bottom input of each multiplexor is selected register 76 may be parallel loaded. Thus for example, value on the line 111*a* and value on the line 111 b can be parallel loaded into registers 103 and 105 respectively when the bottom inputs to the multiplexors are selected.

Figure 5:
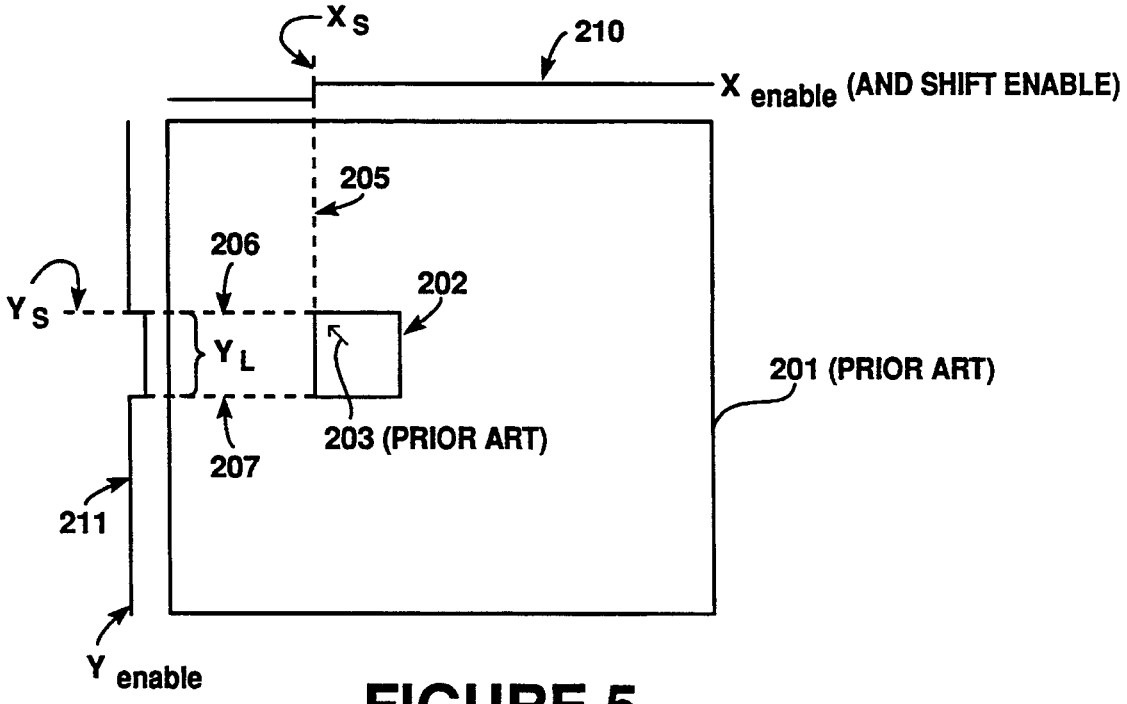
FIG. 5 shows a computer screen with the cursor 203 contained within the cursor area 202 which is stored in the cursor memory.

It can be seen at a normal operation, that register 76 will be parallel loaded during a horizontal retrace and immediately following the inactivation of the load enable signal LDEN1 the register 76 will change to a recirculation mode during which it recirculates and thereby retains the data and waits to receive the shift enable signal which will cause the shifting out of serial cursor data from the register 50. The shift enable signal occurs whenever the current X location of the raster scan refresh operation reaches the Xs position, which is the upper left hand corner of the cursor block 202 as shown in FIG. 5.

The structure and operation of the cursor controller 53 will now be described by referring to FIGS. 5, 6*a*, 6*b*, 6*c* and 7. FIG. 5 shows the cursor block 202 which is stored in the cursor memory 51; typically, this block has a width and length of many pixels (e.g. 32 pixels). It will be appreciated that prior art input devices will control the position of the cursor on the screen and will provide that position in the form of the starting position Xs, Ys to the cursor generator of the present invention. The vertical length of the cursor, $Y_L$, is determined by the predetermined size of the cursor block 202 which may be modified as required in order to suit the purposes of the user of the computer system as long there is sufficient memory in cursor memory 51. Two signals provided by the cursor controller 53 are shown superimposed relative to the screen 201 and the cursor block 202 in FIG. 5 in order to indicate the dependence of these signals on the position of the cursor block 202. Specifically, the X enable signal 21 0 (which is also the shift enable signal) is shown as active during the refresh of the display device after the position Xs and is shown as inactive prior to that position on a particular scan line. The Y enable signal 211 is shown as active only for those scan lines which intersect the cursor block 202.

Figure 6A:
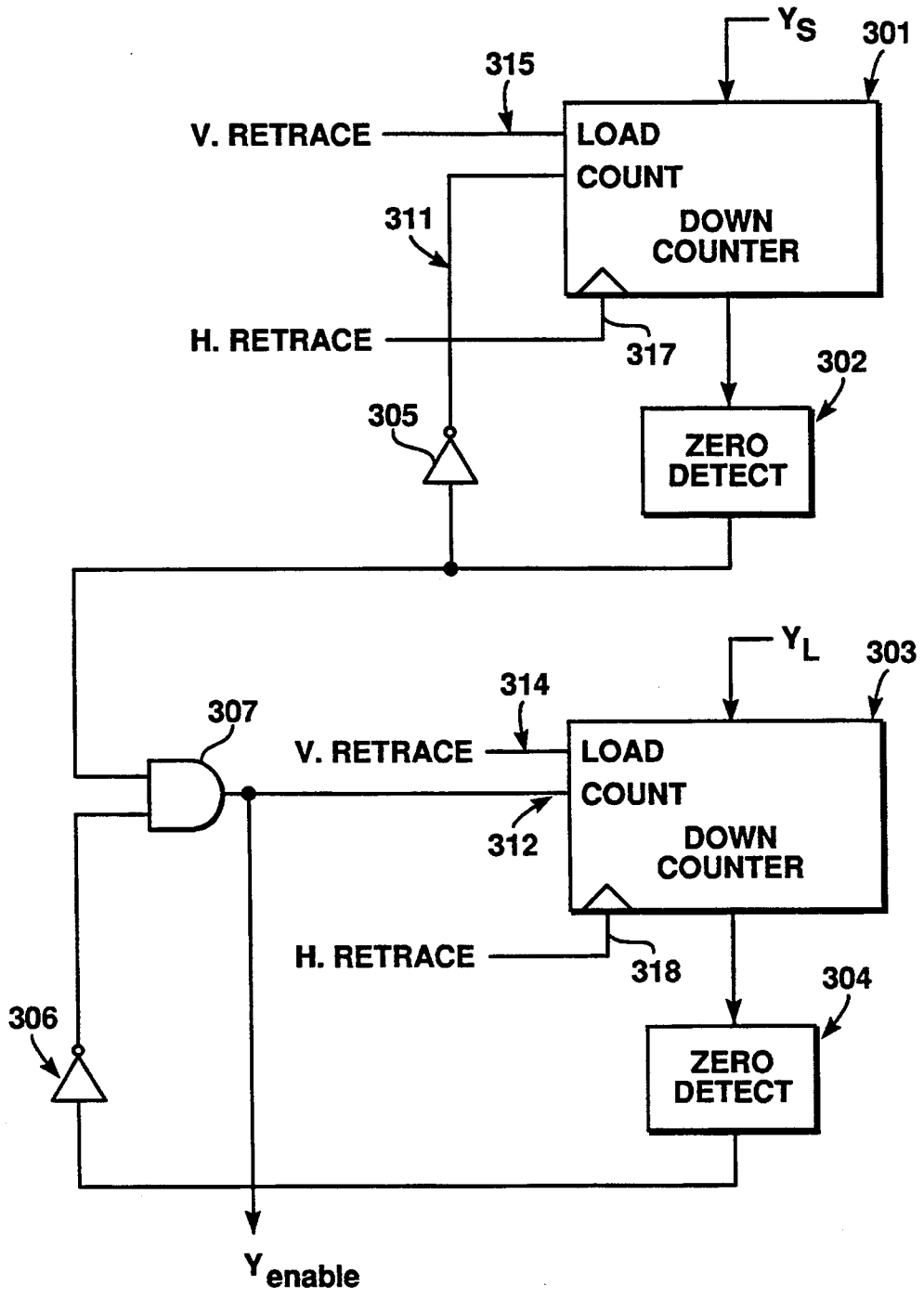
FIG. 6*a* shows an implementation of an apparatus for providing one of the control signals provided by the cursor controller of the present invention.

FIG. 6*a* shows an example of a circuit for producing the Y enable signal. This circuit includes two conventional down counters 301 and 303 as well as two conventional zero detect components 302 and 304. The Y enable generator also includes an AND gate 307 and two inverters 305 and 306. The load control inputs 314 and 315 of both down counters 303 and 301 are coupled to receive the conventional vertical retrace signal which is active only during the vertical retracing of a conventional raster scan display device. The clock inputs 317 and 318 of both down counters 301 and 303 are coupled to receive the conventional horizontal retrace signal which is active only during a horizontal retrace during the refresh operation. The count control inputs 311 and 312 for counters 301 and 303 control whether or not the counter counts down (assuming that the load input has not been activated by the vertical retrace signal when this signal becomes active).

The Y enable generator shown in FIG. 6*a* operates as follows. During a vertical retrace, the value Ys is loaded into the down counter 301 and the value $Y_L$ is loaded into the down counter 303. After the vertical retrace is over and therefore the signal is inactive, it is possible for both down counters to count if the count control input receives an active signal. Whether these counters do in fact count depends on the output of their associated zero detect circuit. After the vertical retrace is completed, the down counter 301 will count from Ys down to zero on each transition of the horizontal retrace signal as long as the input to the count control 311 is equal to one, which will occur whenever the input to the zero detect 302 is other than a zero. That is, zero detect 302 provides a zero output whenever its input is other than a zero, which zero output will be inverted by inverter 305 to provide a one input to the count control input 311. When the down counter 301 has counted down to zero, the zero detect 302 will provide an output of one which will cause the down counter 301 to stop counting by providing a zero input at the count control input 311, and this will also cause the down counter 303 to start counting since the value of both inputs to AND gate 307 will now be one. It can be seen that the output of this AND gate 307 provides the Y enable signal and also provides the input to the count control input 312 of the down counter 303. The down counter 303 continues counting on each horizontal retrace transition as long as the Y enable signal is a logical one. The zero detect circuit 304 functions in the same manner as the zero detect circuit 302.

Figure 6B:
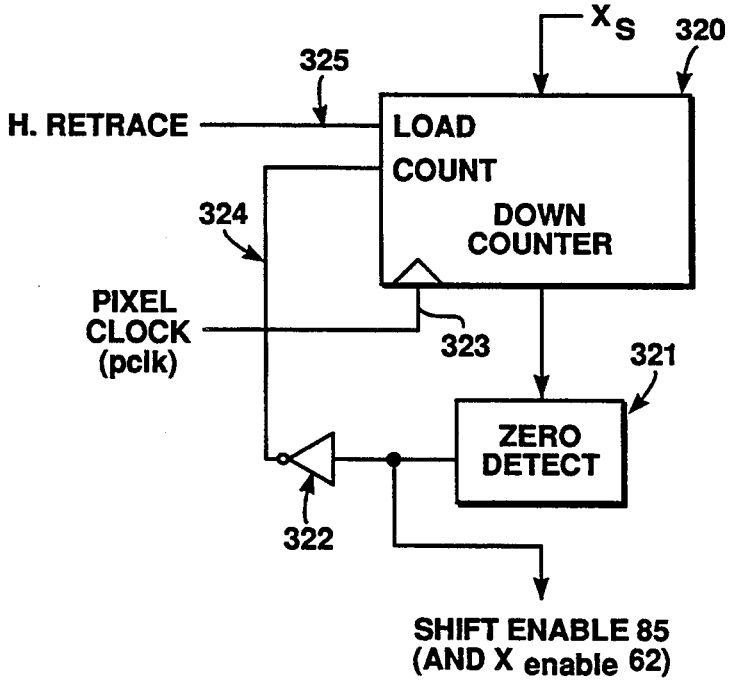
FIG. 6*b* shows an example of an apparatus for providing another control signal of the cursor controller of the present invention.

FIG. 6*b* shows a circuit for generating the shift enable 85 signal (which is also the same as the X enable 62 signal). The down counter 320 and the zero detect circuit 321 function in the same manner as their related components in FIG. 6*a*. The clock input 323 of the down counter 320 is coupled to receive the pixel clock and the load control input 325 is coupled to receive the horizontal retrace signal. The count control input 324 is coupled to receive the output of the inverter 322, the input of which is coupled to the output of the zero detect 321 and to the output of the shift enable generator. When the horizontal retrace signal becomes active the value Xs is loaded into the down counter 320 (but counting does not begin until the horizontal retrace signal becomes inactive). After the inactivation of the horizontal retrace signal, the down counter 320 will count down as long as the output of the down counter does not equal zero. When that output does equal zero, the zero detect 321 will provide an output of one thereby stopping the down counter from counting (because a zero appears at the count input 324) and this will also provide an active shift enable signal 85.

Figure 6C:
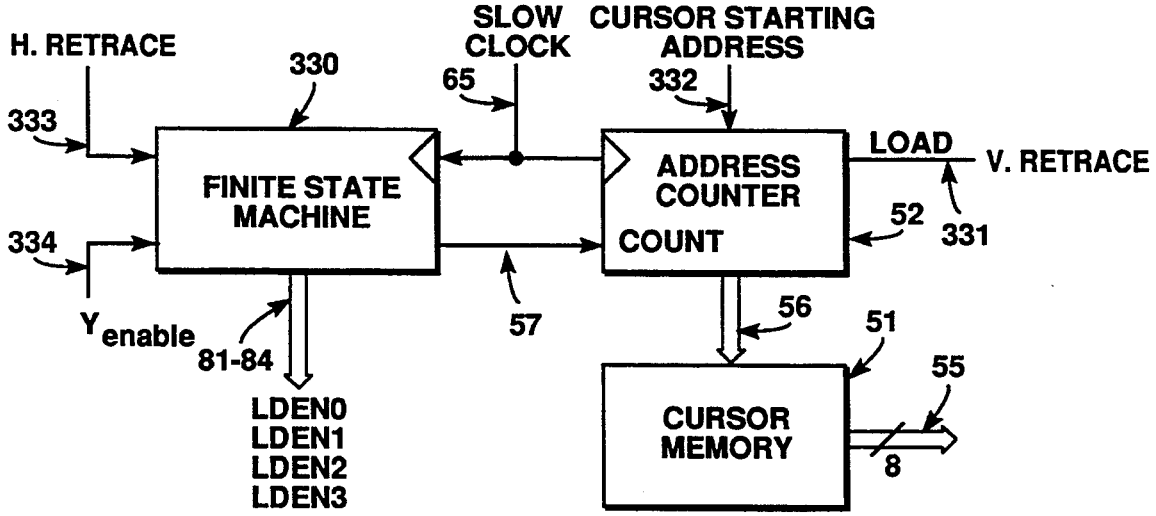
FIGS. 6*c* shows another apparatus within the cursor controller which controls the loading of cursor data from the slow cursor memory to the faster cursor memory.

FIG. 6c shows another component of the cursor controller 53. This component is responsible for controlling the address counter 52 so that it may address the cursor memory 51 to provide cursor data over bus 55 to the shift register 50 during a horizontal retrace. The finite state machine 330 controls the address counter 52 by providing a count output signal over line 57 to a count control input of the address counter 52. The address counter 52 includes a load control input which is coupled to receive the vertical retrace signal, which when active will cause the loading of the cursor starting address 332 into the address counter 52. It will be appreciated that the starting address is the address from which the counter counts down or counts up in the normal manner to provide addresses to the cursor memory 51. This is similar to the way in which the address counter 15 counts addresses for the cursor memory 11 of the cursor generator of the prior art shown in FIG. 1. A slow clock 65 is provided as an input to both the address counter 52 and the finite state machine 330. The finite state machine 330 includes two inputs which are the horizontal retrace signal at input 333 and the Y enable signal at 334, which Y enable signal is generated by the circuit shown in FIG. 6a.

Figure 7:
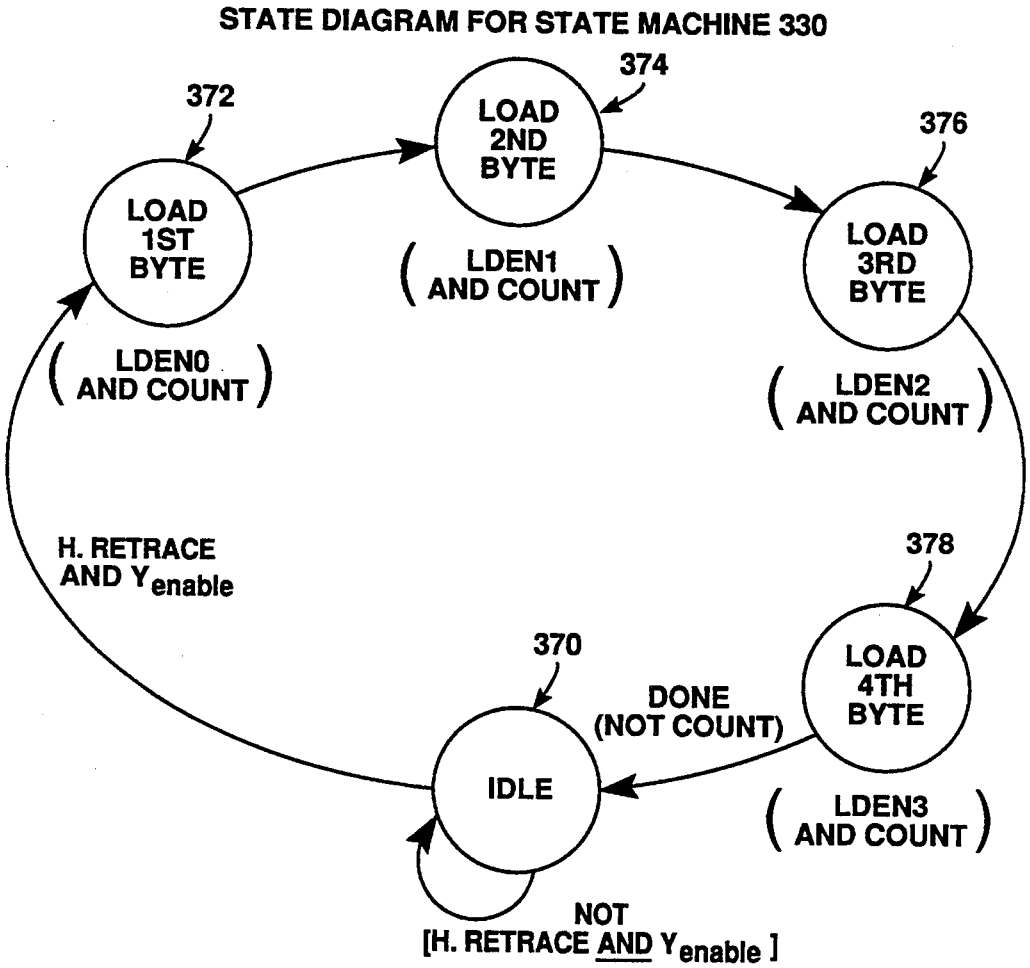
FIG. 7 shows a state diagram for the state machine of FIG. 6*c*.

It will be appreciated that the state of the two inputs (horizontal retrace and Y enable) as well as the state clock of the finite state machine, which is provided by the slow clock 65, will determine the two outputs of the machine 330, which are the count output provided to line 57 and the load enable outputs provided over lines 81, 82, 83 and 84. The construction and operation of this finite state machine 330 will become apparent upon a description of the state machine as shown in FIG. 7. It will first be appreciated that only one load enable signal is active at any particular time if any are to be activated. The output at line 57 of the machine 330 will also be active when any one of the load enable signals is active. The machine 330 typically begins in the idle state 370 shown in FIG. 7. The machine continues in this idle state while the horizontal retrace and the Y enable signals are inactive. As soon as both of these signals become active the machine transitions from the idle state 370 to the state 372 at the next state clock. During state 372, the machine 330 provides the load enable signal for the first register within register 50 by providing the signal LDEN0 and also provides the count signal (on line 57) which is active in order to cause the address counter to address the cursor memory 51 and provide data over bus 55 which is loaded into the first register of the shift register 50 while its load enable input is active. After loading the first byte into the first register of shift register 50 (which is determined by conventional and well known address and control timing criteria), the machine 330 moves at the next state clock to state 374. During state 374, the second byte is loaded into the second register of shift register 50 by providing an active signal on line 82 (while all other load enable signals 81, 83 and 84 are inactive) and by continuing to provide an active count output to line 57. After the second byte as been loaded into the second register 76 of the shift register 50, the state machine 330 moves to the next state 376 during which the third byte is loaded by enabling the load enable signal LDEN2 and keeping the count output on line 57 active while maintaining all other load enable signals as inactive. After loading the third byte into register 77, this state machine proceeds to state 378 during which it loads the fourth byte by setting the load enable signal LDEN3 as active while setting all other load enable signals as inactive and by keeping the count signal at line 57 as active. Following the loading of the fourth byte the state machine 330 stops providing an active count output to line 57 and moves to the idle state 370 from which point the cycle continues.

Several minor modifications, which are easily within the capability of one with ordinary skill in the art, are required to the cursor generator of FIG. 2 in order to provide a multiple value cursor, such as a cursor having four possible binary values. It will be recognized that an additional shift register, such as a shift register 50a, will be provided for each additional binary digit which is sought to be added to the cursor. Each shift register will require four separate load enable signals in addition to the four load enable signals provided by state machine 330. The output of each additional shift register 50, such as shift register 50a, is coupled to a separate AND gate, such as AND gate 54a which also receives the same input 62 as the original AND gate 54. The outputs of the several AND gates 54 and 54a (etc.) will provide a bus 21 containing a multiple value cursor which bus will be coupled to one of the inputs of the multiplexor 12 and to the input of the NOR gate 19. It will be appreciated that for each shift register 50, 50a etc. a separate cursor controller 53 and a separate address counter 52 as well as a separate bit plane with cursor memory 51a may be utilized to load the additional shift registers, such as shift register 50a. Alternatively, it will be appreciated that, if there is sufficient time during a horizontal retrace, the cursor controller 53 could provide eight load enable signals to the eight shift registers (in the case where there are two shift registers 50 and 50a) while causing the address counter 52 to provide eight addresses for eight bytes of data from the cursor memory 51. In this alternative embodiment the finite state machine 330 would provide the four additional load enable signals by providing four additional states. Other modifications to the present invention will be apparent to those skilled in the art upon reference to this disclosure.

The preferred embodiment of the present invention will now be described with reference to FIGS. 8, 9, 10 and 11. This embodiment is utilized whenever the pixel clock rate is so high that CMOS integrated circuits cannot keep up with the data throughput rate required for the stream of serial cursor bits. For example, if the pixel clock is running at 107 MHz, then this embodiment will be required in order to provide the rapid serial stream of cursor bits at the pixel clock rate. These high pixel clock rates are often necessitated in fast computer systems which use large display screens. It may be necessary to implement this embodiment in fast circuit technology, such as ECL, depending on whether or not MOS integrated circuits can attain these high operating frequencies.

Figure 10:
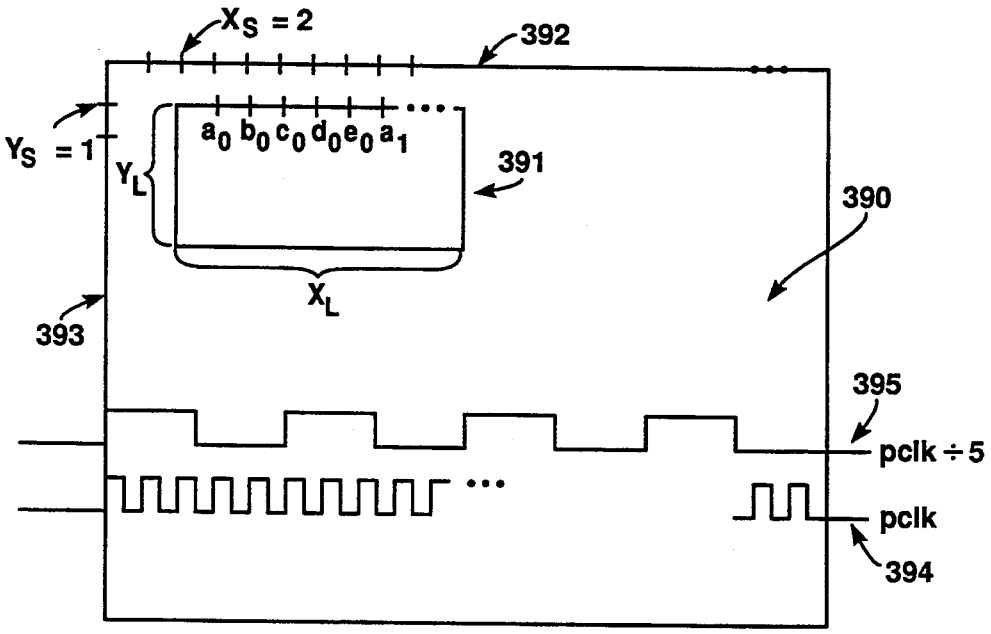
FIG. 10 shows a computer screen and an enlarged cursor area along with pixel clock signals superimposed on the display screen for illustrative purposes.
Figure 8:
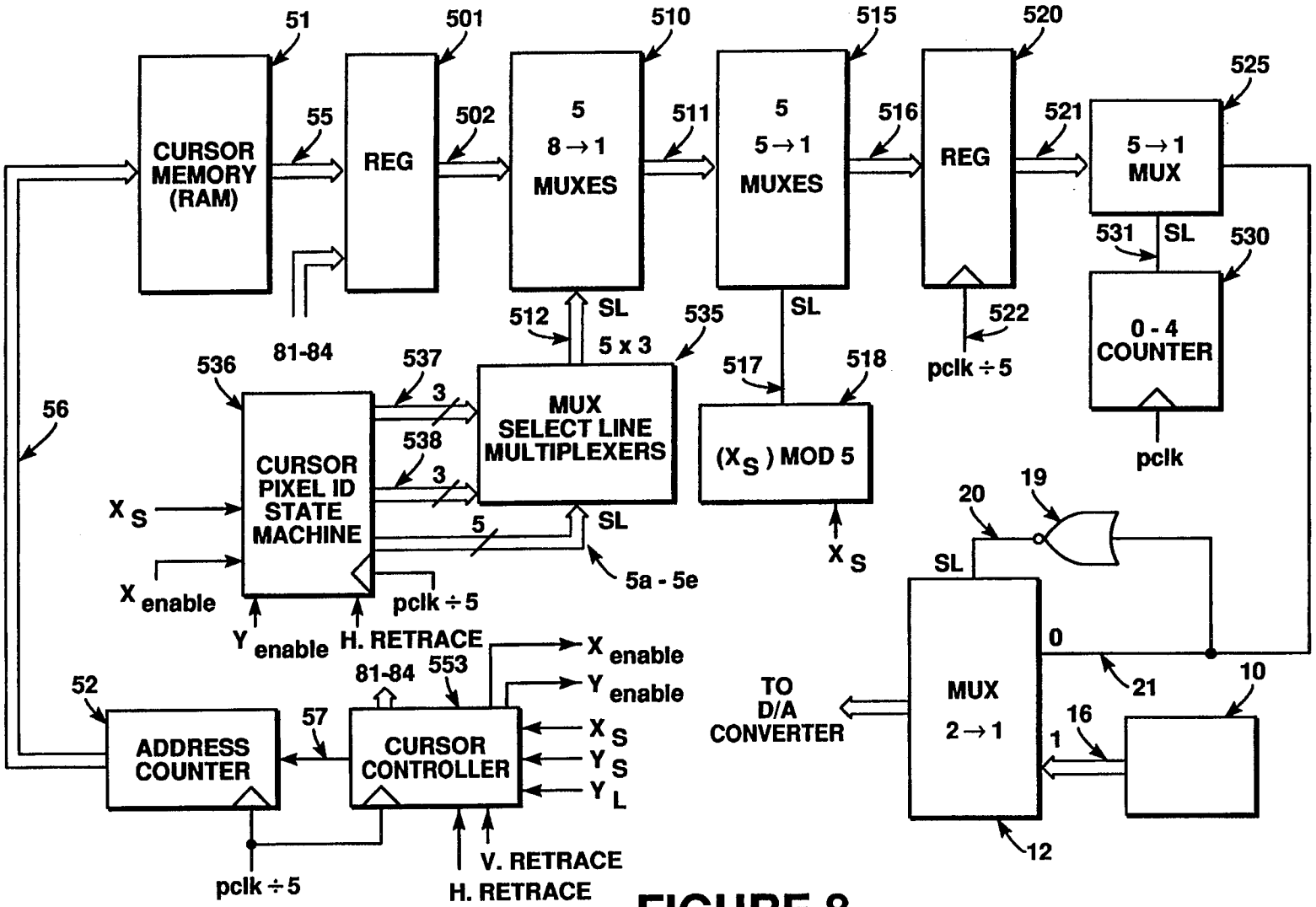
FIG. 8 is a block diagram showing a cursor generator according to a preferred embodiment of the present invention.

FIG. 8 shows in block diagram form the cursor generator of the preferred embodiment which generates a parallel output containing five cursor bits and one of these five bits is selected for display via the multiplexor 525. It will be appreciated that there is some similarity to the embodiment shown in FIG. 2 in that the cursor memory 51 may be the same and the address counter 52 is the same and the cursor controller 553 is the essentially identical to the cursor controller 53 except that no shift enable signal is provided to any register since there is no serial shifting of any shift register in this embodiment. In this embodiment, the pixel clock divided by five ("pclk÷5") functions as the slow clock signal 65 of FIG. 6c. FIG. 10 shows super-imposed upon the screen 390 of the display device 392 the pixel clock 394 and the pixel clock divided by five 395. The cursor controller 553 includes the Y enable generator shown in FIG. 6a as well as the X enable generator shown in FIG. 6b (slightly modified as described below) and the finite state machine 330 shown in FIG. 6c which controls the address counter 52. As with the embodiment shown in FIG. 2, the preferred embodiment, via the cursor controller 553, causes the address counter 52 to generate addresses to parallel load the register 501 during each horizontal retrace when the Y enable signal is active. The logic in controller 553 for generating an "X enable" signal in the preferred embodiment is essentially identical to the logic shown in FIG. 6b except that the clock input 323 of the down counter 320 receives the pclk÷5 signal (i.e. pixel clock divided by 5 signal instead of the pixel clock signal "pclk") and the Xs input to the down counter 320 is the integer value (rounded down) of Xs divided by 5 (rather than Xs). Thus, the down counter 320 counts down to zero from "Integer (Xs/5)" in the preferred embodiment and then provides the X enable signal which is used by the state machine 536.

In the preferred embodiment, the cursor block is 32 bits wide along the scan line and is 32 scan lines long. Thus, there are 32 scan lines within the cursor block 391 shown in FIG. 10 and there are 32 pixels along the length of that block which has been designated as $X_L$. As shown in FIG. 10, the cursor starting position is represented by Xs=2 and Ys=1.

The signals on lines 81, 82, 83 and 84 from the cursor controller 553 (and specifically the machine 330) provide the clock signals for the register 501 since in this embodiment there is no need for a separate clock signal to the registers to provide for loading of the four 8 bit registers 501a, 501b, 501c, and 501d within the register 501.

Figure 9:
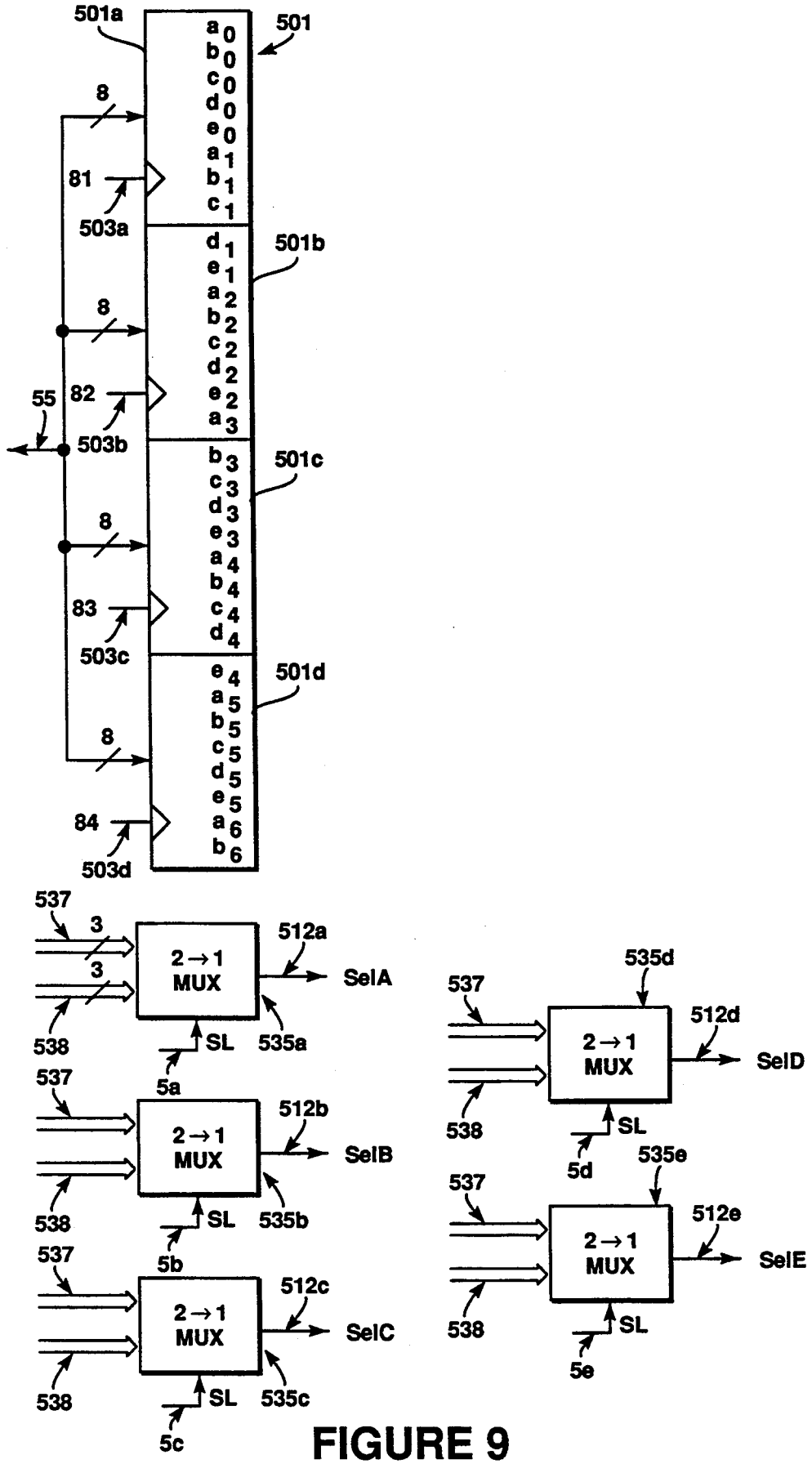
FIG. 9 shows in more detail a portion of the cursor generator of FIG. 8.
Figure 9:
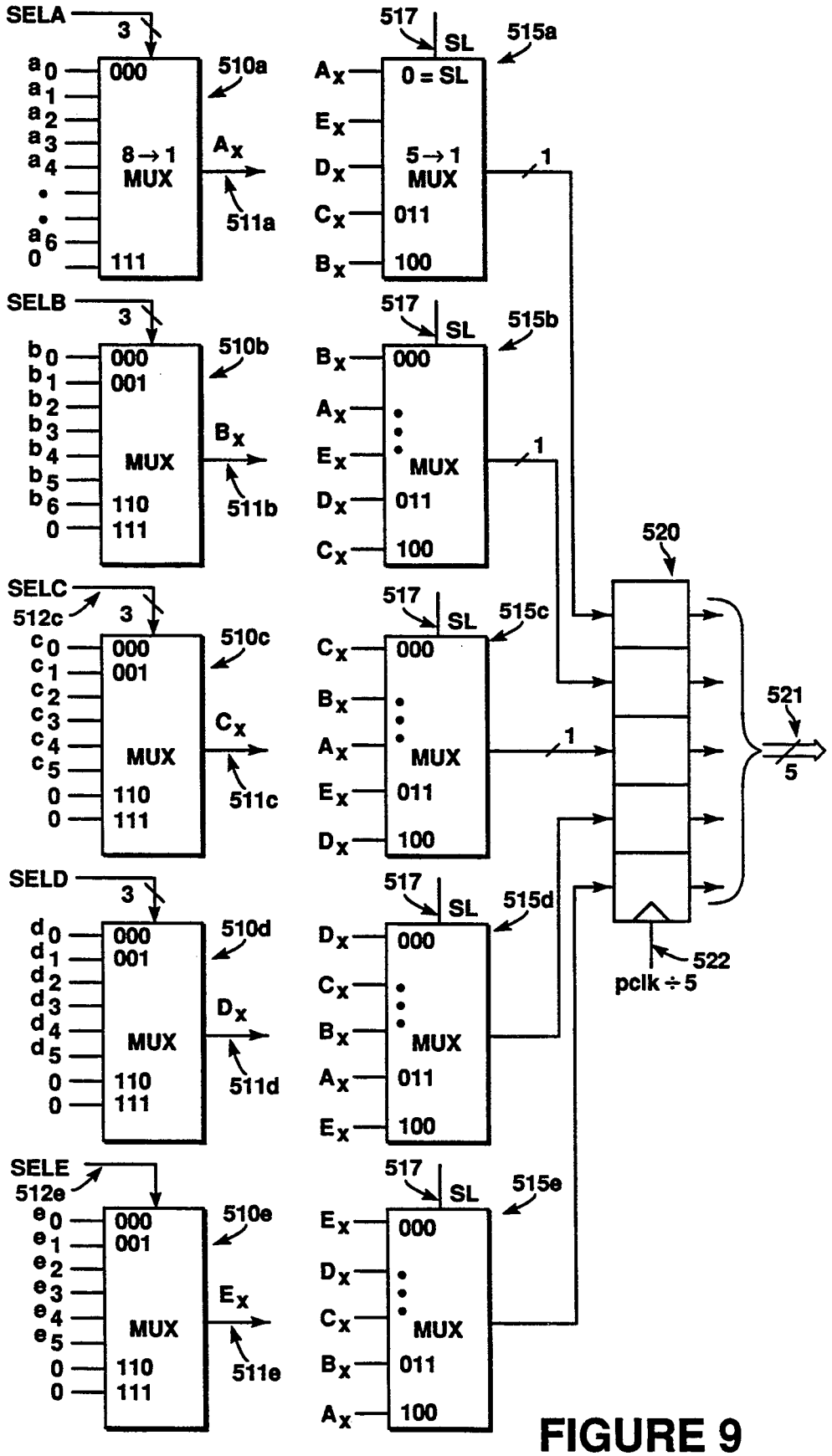

The outputs of register 501 are coupled in the manner shown in FIG. 9 to the five 8 to 1 multiplexors 510 (510a, 510b, 510c, 510d and 510e) which are controlled by five different select lines 512 (shown in FIG. 9 as lines 512a, 512b, 512c, 512d and 512e). The outputs of these five multiplexors 510 are coupled through bus 511 in the manner shown in FIG. 9 to five 5 to 1 multiplexors 515 (515a, 515b, 515c, 515d and 515e) which are controlled by the select line 517 which is provided by the modulo five operator 518. The output of the five muxes of 515 is coupled through bus 516 to the register 520 which is a 5 bit parallel/in parallel out register which is clocked in and out under the control of the pixel clock divided by 5 signal at clock input 522.

The output of register 520 as shown in FIG. 8 is coupled through bus 521 to the 5 to 1 multiplexor 525 which serializes the output of the register 520 under the control of the counter 530 which counts from zero to four repetitively on each pixel clock. The serialized output from multiplexor 525 is then coupled to the NOR gate 19 and to the "0" input of the multiplexor 12 via line 21. It will be appreciated that multiplexor 12 as well as NOR gate 19 and the select line 20 operate in the preferred embodiment in the same manner in which they operate in the embodiment shown in FIG. 2.

As shown in FIG. 8, the five multiplexors 510 are controlled by the cursor pixel identification (ID) state machine 536 and the multiplexors 535. The cursor pixel state machine 536 provides the current ID value over bus 537 and provides the previous ID value over bus 538; these two values are provided as inputs to the five (5 to 1) multiplexors which make up the multiplexors 535. These five multiplexors each have one select line making up the select lines 5a, 5b, 5c, 5d and 5e, the values of which are controlled by the cursor pixel ID state machine 536. The operation of this state machine, based upon it inputs, will be described below with reference to FIG. 11. The five multiplexors making up multiplexors 535 provide the five different select line signals, selA, selB, selC, selD, selE, to the five multiplexors 510a, 510b, 510c, 510d and 510e as shown in FIG. 9.

FIG. 9 shows the detailed interconnections between the register 501 and the five multiplexors 510. FIG. 9 also shows the interconnections between the five multiplexors 510 and the five multiplexors 515, and FIG. 9 also shows the interconnections between the five multiplexors 515 and the register 520. For example, the first bit location (labelled $a_0$) in the register 501a is coupled to the first select input of multiplexor 510a and this location $a_0$ will be selected for output from mux 510a when selA has the value 000. Similarly, the first bit location (labelled $d_1$) in register 501b is connected to the second select input (which is selected for output when the select line control selD is equal to 001) of the multiplexor 510d. It can be seen that the five multiplexors 535a, 535b, 535c, 535d and 535e provide either the previous ID or the current ID value to the five different select lines of the five different multiplexors 510a, 510b, 510c, 510d and 510e. It can be seen from FIG. 9 that each 8 bit register of the 32 bit register 501 will receive a parallel-in 8 bit value when its clock input (e.g. 503a) receives a clocking signal from one of the four different load signals present on lines 81, 82, 83 and 84. Thus, register 501a will first load with 8 bits arranged in the manner shown (e.g. $a_0$, $b_0$, $c_0$, etc.) and then the register 501b will receive an 8 bit parallel in value, etc. Each bit location within register 501 may be a simple D flip flop with its D input coupled to one of the 8 input lines and the Q output coupled to the appropriate multiplexor of the five multiplexors 510 as shown in FIG. 9.

The output of each multiplexor of the five multiplexors 510 is coupled to five different inputs on the five multiplexors 515. For example, the output Ax from multiplexor 510a, which output appears at line 511a is coupled to the 000 input of multiplexor 515a, which input is selected for output from mux 515a when the select line 517 provides the value 000. Similarly, the output Ax on line 511a is coupled to the 001 input of multiplexor 515b and is coupled to the 010 input of multiplexor 515c. The output from each of the multiplexors which are part of the five multiplexors 515 is provided to the register 520 as shown in FIG. 9. The select line 517 is coupled to receive a value provided by the (Xs) modulo 5 operator 518 which computes the value of the operation (Xs) modulo 5 given the input of Xs. Thus, it can be seen that the starting X position will determine the select line for all five multiplexors 515. The operation of the select lines for the five multiplexors 510 is considerably more complicated and will described by referring to chart A and chart B below in conjunction with FIGS. 10 and 11.

CHART A

| ($X_s$) Modulo 5=2(e.g. $X_s$=2; $X_s$=7; $X_s$ = 12 . . . ) | out. reg. (520) | output of 1st set of muxes (510) | sel A | sel B | sel C | sel D | sel E |
|---|---|---|---|---|---|---|---|
| | $D_x$ $E_x$ $A_x$ $B_x$ $C_x$ | $A_x$ $B_x$ $C_x$ $D_x$ $E_x$ | 000 | 000 | 000 | 111 | 111 |
| 1st pclk ÷ 5 | 0 0 $a_0$ $b_0$ $c_0$ | $a_0$ $b_0$ $c_0$ 0 0 | | | | | |
| current ID = 0/5 = 0 | | inputs to MUX sel.(535): current ID = 000; previous ID = 111 | | | | | |
| previous ID = 7 | | 5a = 5b = 5c = current (0); 5d = 5e = 1 (previous) | | | | | |
| | $D_x$ $E_x$ $A_x$ $B_x$ $C_x$ | $A_x$ $B_x$ $C_x$ $D_x$ $E_x$ | | | | | |
| 2nd pclk ÷ 5 | $d_0$ $e_0$ $a_1$ $b_1$ $c_1$ | $a_1$ $b_1$ $c_1$ $d_0$ $e_0$ | 001 | 001 | 001 | 000 | 000 |
| current ID = 5/5 = 1 | | inputs to MUX sel.(535): current ID = 001; previous ID = 000 | | | | | |
| | | 5a = 5b = 5c = 0 (current); 5d = 5e = 1 (previous) | | | | | |
| | $D_x$ $E_x$ $A_x$ $B_x$ $C_x$ | $A_x$ $B_x$ $C_x$ $D_x$ $E_x$ | | | | | |
| 3rd pclk ÷ 5 | $d_1$ $e_1$ $a_2$ $b_2$ $c_2$ | $a_2$ $b_2$ $c_2$ $d_1$ $e_1$ | 010 | 010 | 010 | 001 | 001 |
| current ID = 10/5 = 2 | | inputs to MUX sel.(535): current ID = 010; previous = 001 | | | | | |
| | | 5a = 5b = 5c = 0; 5d = 5e = 1 (previous) | | | | | |
| | $D_x$ $E_x$ $A_x$ $B_x$ $C_x$ | $A_x$ $B_x$ $C_x$ $D_x$ $E_x$ | | | | | |
| 4th pclk ÷ 5 | $d_2$ $e_2$ $a_3$ $b_3$ $c_3$ | $a_3$ $b_3$ $c_3$ $d_2$ $e_2$ | 011 | 011 | 011 | 010 | 010 |
| current ID = 15/5 = 3 | | inputs to MUX sel.(535): current ID = 011;previous = 010 | | | | | |
| | | 5a = 5b = 5c = 0; 5d = 5e = 1 (previous) | | | | | |
| | $D_x$ $E_x$ $A_x$ $B_x$ $C_x$ | $A_x$ $B_x$ $C_x$ $D_x$ $E_x$ | | | | | |
| 5th pclk ÷ 5 | $d_3$ $e_3$ $a_4$ $b_4$ $c_4$ | $a_4$ $b_4$ $c_4$ $d_3$ $e_3$ | 100 | 100 | 100 | 011 | 011 |
| current ID = 20/5 = 4 | | inputs to MUX sel.(535): current ID = 100; previous ID = 011 | | | | | |
| | | 5a = 5b = 5c = 0; 5d = 5e = 1 (previous) | | | | | |
| | $D_x$ $E_x$ $A_x$ $B_x$ $C_x$ | $A_x$ $B_x$ $C_x$ $D_x$ $E_x$ | | | | | |
| 6th pclk ÷ 5 | $d_4$ $e_4$ $a_5$ $b_5$ $c_5$ | $a_5$ $b_5$ $c_5$ $d_4$ $e_4$ | 101 | 101 | 101 | 100 | 100 |
| current ID = 25/5 = 5 | | inputs to MUX sel.(535): current ID = 101; previous ID = 100 | | | | | |
| | | 5a = 5b = 5c = current = 0; 5d = 5e = 1 | | | | | |
| | $D_x$ $E_x$ $A_x$ $B_x$ $C_x$ | $A_x$ $B_x$ $C_x$ $D_x$ $E_x$ | | | | | |
| 7th pclk ÷ 5 | $d_5$ $e_5$ $a_6$ $b_6$ 0 | $a_6$ $b_6$ 0 $d_5$ $e_5$ | 110 | 110 | 110 | 101 | 101 |
| current ID = 30/5 = 6 | | inputs to MUX sel.(535): current ID = 110; previous ID = 101 | | | | | |
| | | 5a = 5b = 5c = current = 0; 5d = 5e = 1 | | | | | |

The values shown in chart A are based upon an example where the starting cursor position (Xs) is such that the value of Xs modulo 5 is equal to 2. FIG. 10 shows such an example. It can be seen from this figure that when the starting horizontal location of the cursor block is other than at every fifth pixel along the scan line, it will be required to provide beginnings zeros from the cursor generator because the pixel clock divided by five 395 is in the middle of the high state when the pixel clock requires five pixels to be outputed from the cursor generator. These leading zeros cover the beginning of a block of 5 pixels. Therefore, it can be seen from chart A that the first output at the first pixel clock divided by five (which correspond to state 906 in FIG. 11 ) from the output register 520 will have the values 0, 0, $a_0$, $b_0$, $c_0$ in that order listed from top to bottom of register 520 and this order will also be the serial output from multiplexor 525. In other words, the outputs from the multiplexors 510*d* and 510*e* have been routed to appear first in the stream of a group of five pixels from the register 520 and then the output from registers 510*a*, 510*b*, and 510*c* has been provided to appear in that order following the output of multiplexor 510*e*. Chart A shows, for each of the 7 states 906, 908, 910, 912, 914, 916, 918 of FIG. 11, the values of the output register 520, the outputs of each of the multiplexors in the set of multiplexors 510, and the values on the 5 select lines 512*a* (selA), 512*b* (selB), 512*c* (selC), 512*d* (selD) and 512 (selE). The far left column in chart A shows the particular state (e.g. 3rd pclk÷5 is state 910 of FIG. 11); the next column (going left to right) shows the output of register 520 (from top to bottom, assuming the top output is selected first by the multiplexor 525 and the bottom output is selected last by mux 525). The next column shows the output of multiplexors 510 and the right-most group of columns shows the select lines 512*a* through 512*e*. The output of the first set of multiplexors 510 will now be described by referring to chart B along with FIG. 11 which shows the state diagram for the cursor pixel ID state machine 536 of FIG. 8.

CHART B

Decoder Logic for providing five select lines 5a, 5b, 5c, 5d and 5e to the Muxes 535a, 535b, 535c, 535d and 535e:
if (Xs) Modulo 5 = 1, then 5e = select previous ID (input 538)
and 5a = 5b = 5c = 5d = select current ID (input 537);
if (Xs) Modulo 5 = 2, then 5e = 5d = select previous ID (input 538)
and 5a = 5b = 5c = select current ID (input 537);
if (Xs) Modulo 5 = 3, select then 5e = 5d = 5c = select previous ID (input 538)
and 5a = 5b = select current ID (input 537);
if (Xs) Modulo 5 = 4, then 5e = 5d = 5C = 5b = select previous ID (input 538)
and 5a = select current ID;
if (Xs) Modulo 5 = 0 then 5a = 5b = 5c = 5d = 5e = select current ID (input 537).

Chart B shows the decoder logic within state machine 536 for providing the values on the five different select lines 5*a* through 5*e* which are used to select between the current ID value (537) or the previous ID value (538), which values are the two inputs to the five multiplexors 535*a* through 535*e*. In turn, these multiplexors provide, via their outputs, the five values for the select lines selA, selB, selC, selD and selE. The input 537 is the current input (selected when the select line 5*a*, 5*b* . . . is zero as shown in chart A), and the input 538 is the previous ID value which is selected when the select line to the particular 535 multiplexor is a one.

The current ID value and the previous ID value are determined by the current pixel ID state machine 536 which has four inputs Xs, X enable, Y enable and horizontal retrace along with the state clock which is the pixel clock divided by five. It can be seen that the cursor pixel ID state machine, when the cursor image is being refreshed on a display device, steps through the current ID and previous ID values on each pixel clock divided by five in order to rotate through all thirty two values for the cursor on a scan line and in order to provide beginning zeros and trailing zeros from the output of the cursor generator. The state machine 536 typically begins in the idle state 902 during which the machine 536 waits for the condition when the horizontal retrace signal and the Y enable signal are both active; otherwise, the state machine remains in the idle state 902. During the idle state, the previous ID value and the current ID value are both 111 (binary) to assure that only zeros are output from register 520. When the horizontal retrace and the Y enable signal are both active, the state machine 536 proceeds to state 904 in which it waits for the X enable signal to become active. Again, during this wait state, the previous ID value and the current ID value are both 111 (binary) to assure that only zeros are output from register 520. When the X enable signal becomes active, the state machine proceeds to state 906 which occurs at the first pixel clock divided by five. During this state, the current ID value for the cursor pixel is 000 (thus the state machine 536 provides the value 000 to input 537) and the previous ID is 111 (thus the state machine 536 provides the value of 111 to input 538); also during this state, the state machine 536 computes the values for the five select lines 5*a* through 5*e* according to decoder logic provided in chart B. It can be seen from chart A that during state 906, in the circumstance shown in FIG. 10 where Xs=2, the output of multiplexor 510*d* (the output Dx) will be a zero since the previous ID value of 111 is provided over select line 512*d* (selD) which causes the selection of the input 111 to the multiplexor 510*d* , which input is tied to logical zero. It can also be seen that the output of the multiplexor 510*a* during the first pixel clock divided by 5 is $a_0$ as the select line selA will provide the value of 000 which causes the selection of the a0 input to the multiplexor 510*a*. It can then be seen that the output for multiplexor 510*a* during this first pixel clock divided by five will be outputed only by multiplexor 515*c* since that is where the Ax input is connected to one of the five multiplexors 515 at the 010 position (note that 010 is the binary value of the decimal number 2 which is the result of (2) modulo five).

Figure 11:
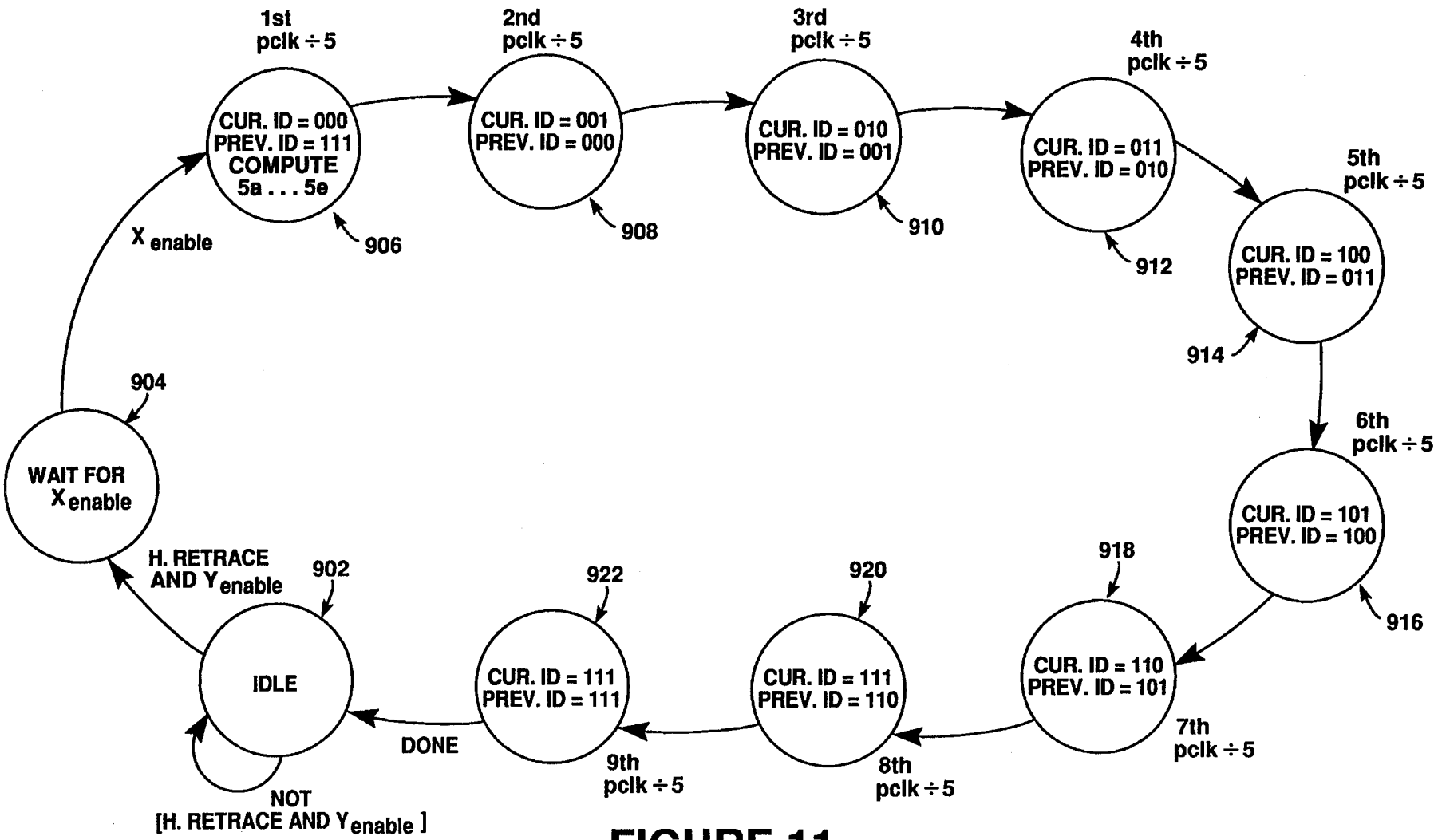
FIG. 11 shows a state clock diagram for the cursor pixel identification state machine of FIG. 8.

On each of the next eight pixel clock divided by five transitions, the state machine 536 will move to states 908, 910, 912, 914, 916, 918, 920 and 922 as shown in FIG. 11 and will provide the current ID and previous ID values as shown in FIG. 11. It will be appreciated that these current and previous values will be provided by the state machine 536 regardless of the modulo five value and it will also be appreciated that the modulo five value will determine which multiplexors in multiplexor 510 will receive for its select line input the current ID value and the previous ID value. After state 922 the state machine 536 proceeds back to the idle state 902, Although the present invention has been described in terms of two embodiments, it will be appreciated that various modifications and alterations may be made to these embodiments by those skilled in the art without departing from the spirit and scope of the invention.

I claim:

1. In a computer controlled display system having a raster scanned display device, an apparatus for generating a cursor for display on said display device, said apparatus comprising:

a first memory means for storing the entire cursor, said cursor comprising a plurality of portions of raster scanned lines representing attributes of said cursor, said raster scanned lines further comprising bit values;

an input register being communicatively coupled to said first memory means;

control means for addressing said first memory means to obtain one of said plurality of portions of raster scanned lines and for loading said one of said plurality of portions of raster scanned lines into said input register;

a first multiplexing means, data inputs of said first multiplexing means coupled to said input register;

a second multiplexing means coupled to said first multiplexing means;

a means for controlling said first multiplexing means and said second multiplexing means, said means for controlling being coupled to said first and said second multiplexing means;

an output register being coupled to said second multiplexing means to receive said bit values of said one of said plurality of portions of raster scanned lines, said means for controlling providing signals to route said bit values from said input register to said output register.

2. An apparatus as in claim 1 further comprising an output multiplexing means coupled to said output register, and wherein said control means addresses said first memory means during a horizontal retrace of said display device and wherein said first memory means is comprised of random access memory and wherein said output register provides a parallel output which is serialized by said output multiplexing means.

3. In a computer controlled display system having a raster scanned display device, an apparatus for generating a cursor for display on said display device, said apparatus comprising:

a first memory means for storing the entire cursor, said cursor comprising a plurality of raster scanned lines representing attributes of said cursor, said raster scanned lines further comprising a plurality of portions wherein each portion comprises bit values;

an input register communicatively coupled to said first memory means;

control means for addressing said first memory means to obtain said plurality of portions of a raster scanned line and for loading said plurality of portions of a raster scanned line into said input register;

a multiplexing means for routing bit values of said plurality of portions of a raster scanned line, data inputs of said multiplexing means coupled to said input register, said multiplexing means comprising:

a first plurality of multiplexers coupled to said plurality of portions wherein at least one multiplexer of said first plurality of multiplexers routes first bit values of each of said plurality of portions to an output port; and a second plurality of multiplexers coupled to said first plurality of multiplexers for allowing selection of bit ordering of bit values of said plurality of portions;

a means for controlling said multiplexing means, said means for controlling being coupled to said multiplexing means; and an output register being coupled to said multiplexing means to receive said bit values of said plurality of portions of a raster scanned line, said means for controlling providing signals to route said bit values from said input register to said output register.

4. An apparatus as in claim 3 further comprising an output multiplexing means coupled to said output register for serializing output supplied from said output register, and wherein said control means addresses said first memory means during a horizontal retrace of said display device and wherein said first memory means is comprised of random access memory.

5. In a computer controlled display system utilizing raster scan update to update a display means, an apparatus for generating a cursor for display on said display means, said apparatus comprising:

cursor memory means for storing image attribute data of said cursor for display on said display means, said image data comprising a plurality of data lines, each data line displayed on said display means in synchronization with said raster scan update;

a first register coupled to said cursor memory for receiving a particular data line of said plurality of data lines at a first clock rate, said particular data line comprising data in a repetitive series of groups;

a second register for providing output of said particular data line at a second clock rate, said second clock rate having a more rapid frequency than said first clock rate; and multiplexer means coupled to said first register and to said second register for routing data of said particular data line of said first register to said second register via a plurality of data frames so that said second register can be continuously read by said display system at said second clock rate, said multiplexer means further comprising:

a first multiplexing means coupled to said first register for selecting particular elements from each of said series of groups of said particular data line; and a second multiplexing means coupled to said first multiplexing means and also coupled to said second register means for determining an output group order of said series of groups of said particular data line, said output group order based on a position of said cursor on said display means.

6. An apparatus for generating a cursor for display on said display means as described in claim 5 further comprising display update means for generating said cursor on said display means, said display update means coupled to said second register and wherein said multiplexer means allows said particular data line to begin outputting to said display update means at a point in time that is not in synchronization with said first clock rate but is in synchronization with said second clock rate.

7. An apparatus for generating a cursor for display on said display means as described in claim 5 wherein said plurality of dataframes is routed to said second register at a frequency of said first clock rate and each of said plurality of dataframes is read by said display system at said second clock rate.

8. An apparatus for generating a cursor for display on said display means as described in claim 5 further comprising:

a pixel counter for counting at said second clock rate;

an output multiplexing means having data input coupled to said second register and select input coupled to said pixel counter; and display update means for refreshing a raster scan line on said display system, said display update means coupled to data output of said output multiplexing means, wherein said output multiplexing means provides a serial data stream representing said particular data line to said display update means at said second clock rate.

9. An apparatus for generating a cursor for display on said display means as described in claim 5 further comprising:

control means coupled to said cursor memory for transferring said particular data line from said cursor memory to said first register at said first clock rate.

10. An apparatus for generating a cursor for display on said display means as described in claim 5 wherein each of said plurality of dataframes routed to said second register is determined based on said particular elements selected by said first multiplexing means and said output group order of said series of groups determined by said second multiplexing means.

11. In a computer controlled display system utilizing raster scan update to update a display means, an apparatus for generating a cursor for display on said display system, said apparatus comprising:

cursor memory means for storing image attribute data of said cursor for display on said display system, said image data comprising a plurality of data lines, each data line displayed on said display means in synchronization with said raster scan update;

a first register coupled to said cursor memory for receiving a particular data line of said plurality of data lines at a first clock rate, said particular data line comprising data in a repetitive series of groups;

a second register for providing output of said particular data line at a second clock rate, said second clock rate having a more rapid frequency than said first clock rate; and multiplexer means coupled to said first register and to said second register for routing data of said particular data line of said first register to said second register, said multiplexer means further comprising:

a first multiplexing means coupled to said first register for selecting particular elements from each of said series of groups of said particular data line; and a second multiplexing means coupled to said first multiplexing means and also coupled to said second register means for determining an output group order of said series of groups of said particular data line, said output group order based on a position of said cursor on said display means; and display update means for generating said cursor on said display means, said display update means coupled to said second register and wherein said multiplexer means enables bits of said second register to be serially supplied to said display update means at a rate of at least 107 megahertz.

12. An apparatus for generating a cursor for display on said display system as described in claim 11 wherein said multiplexer means allows said particular data line to begin being output to said display update means at a point in time that is not in synchronization with said first clock rate but is in synchronization with said second clock rate.

13. An apparatus for generating a cursor for display on said display system as described in claim 11 wherein said second clock rate is at least 107 megahertz.

14. An apparatus for generating a cursor for display on said display system as described in claim 11 wherein said display update means comprises:

a pixel counter for counting at said second clock rate;

an output multiplexing means having a data input coupled to said second register and a select input coupled to said pixel counter; and digital to analog conversion means for refreshing a raster scan line on said display system, said digital analog conversion means coupled to a data output of said multiplexing means, wherein said output multiplexing means provides a serial data stream representing said particular data line to said digital to analog conversion means at said second clock rate.

15. An apparatus for generating a cursor for display on said display system as described in claim 11 further comprising:

control means coupled to said cursor memory for transferring said particular data line for said cursor memory to said first register at said first clock rate.

16. An apparatus for generating a cursor for display on said display system as described in claim 11 wherein data of said particular data line routed to said second register is determined based on said particular elements selected by said first multiplexing means and said output group order of said series of groups determined by said second multiplexing means.

* * * * *